United States Patent [19]

Senba et al.

[11] Patent Number: 4,528,432

[45] Date of Patent: Jul. 9, 1985

[54] VACUUM INTERRUPTER

[75] Inventors: Katsuaki Senba; Junichi Warabi, both of Numazu, Japan

[73] Assignee: Kabushiki Kaisha Meidensha, Tokyo, Japan

[21] Appl. No.: 611,978

[22] Filed: May 18, 1984

[30] Foreign Application Priority Data

May 20, 1983 [JP] Japan ..... 58-88745

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,727,018 | 4/1973 | Wesoloski et al | 200/144 B |
| 4,077,114 | 3/1978 | Sakuma | 200/144 B |
| 4,394,554 | 7/1983 | Warabi et al. | 200/144 B |
| 4,408,107 | 10/1983 | Sakuma et al. | 200/144 B |

FOREIGN PATENT DOCUMENTS

| | | |
|---|---|---|
| 43258 | 1/1983 | European. |
| 80315 | 6/1983 | European. |
| 2380665 | 9/1978 | France. |
| 2659871 | 10/1977 | Fed. Rep. of Germany. |
| 1298448 | 12/1972 | United Kingdom. |

*Primary Examiner*—Robert S. Macon

*Attorney, Agent, or Firm*—Schwartz, Jeffery, Schwaab, Mack, Blumenthal & Evans

[57] ABSTRACT

A vacuum interrupter, an envelope of which includes a pair of electrical lead rods of copper or copper-based alloy, one lead rod being brazed vacuum-tight to one end plate via a first tubular sealing member fitted onto one rod, and a bellows surrounding another lead rod, an outer end of the bellows being joined vacuum-tight to another end plate and an inner end of the bellows being brazed vacuum-tight to the other lead rod via a second tubular sealing member fitted onto the other lead rod. Each sealing member is made of an iron-based alloy and has an inner wall including a groove retaining solid brazing metal and two vacuum-tight brazing surfaces opposing each rod across a small clearance. The molten brazing metal permetates through the clearance due to wetablility and capillary action without erodingly diffusing into the opposing surfaces of the lead rods and the first and second sealing members.

10 Claims, 11 Drawing Figures

VACUUM INTERRUPTER

BACKGROUND OF THE INVENTION

1. Field of the Invention

The present invention relates to a vacuum interrupter, more particularly to the vacuum interrupter, an envelope of which includes an improved vacuum-tight brazed seal between an electrical lead rod and another member forming part of the vacuum envelope of the interrupter.

2. Description of the Prior Art

As shown in FIG. 1, the vacuum envelope of a vacuum interrupter generally includes two circular insulating cylinders 1 of glass or alumina ceramics which are coaxially aligned, four metallic sealing rings 2 of Fe-Ni-Co alloy or Fe-Ni alloy, each of which is joined in a vacuum-tight manner to one end of an insulating cylinder 1, two sealing rings 2 at the opposing ends of the insulating cylinders 1 being welded or brazed end-to-end vacuum-tight with a flange 3*a* of an arc shield 3 sandwiched between the sealing rings 2, two annular end plates 4 and 5 of austenitic stainless steel each welded or brazed vacuum-tight to the sealing rings 2 at opposite ends of the resulting assembly, a stationary electrical lead rod 6 of oxygen-free copper or a copper-based alloy which extends through a central aperture 4*a* in the end plate 4 in a vacuum-tight manner, a movable electrical lead rod 7 of oxygen-free copper or a copper-based alloy which extends freely through a central aperture 5*a* in the end plate 5, and a bellows 8 of austenitic stainless steel connecting in a vacuum-tight manner to the end plate 5 and to the movable electrical lead rod 7.

The vacuum-tight brazing is realized in a vacuum brazing process under a high vacuum, the pressure of which is controlled to be 13.3 m Pa ($10^{-4}$ Torr) or lower, or in a hermetically brazing process under an inert or reducing atmosphere, the pressure of which is controlled to be about 1.33 to 1333 Pa ($10^{-2}$ to $10^{1}$ Torr). A typical brazing metal is a Cu-Ag eutectic. Specifically, in the vacuum brazing process, any of the brazing metals listed in the following Table can be used.

TABLE

Vacuum Brazing Metals and Their Melting Points

| No. | Vacuum brazing metals (wt %) | Solidus temp. (°C.) | Liquidus temp. (°C.) |
|---|---|---|---|
| 1 | 61Ag—24Cu—15In | 630 | 685 |
| 2 | 60Ag—27Cu—13In | 635 | 705 |
| 3 | 72Ag—28Cu | 779 | 779 |
| 4 | 20Ag—60Au—20Cu | 835 | 845 |
| 5 | 80Au—20Cu | 889 | 889 |
| 6 | 53Cu—38Mn—9Ni | 880 | 905 |
| 7 | 82Au—18Ni | 950 | 970 |
| 8 | 100Ag | 960 | 960 |
| 9 | 85Ag—15Mn | 960 | 965 |

FIG. 2 illustrates a conventional method for vacuum-tight brazing of the bellows 8 to the movable electrical lead rod 7. First, an upper surface of an annular plate 9 formed at the inner end of the bellows 8 abuts a lower surface of a flange 10 being integral part of the movable electrical lead rod 7, a ring of solid brazing metal 11 being placed in contact with the periphery of the flange 10 and the surface of the annular plate 9. Second, the movable electrical lead rod 7 and the bellows 8 are heated to the melting point of the solid brazing metal 11 for hermetically brazing, until the solid brazing metal 11 melts. In cases where the solid brazing metal 11 can easily alloy with copper but not easily alloy with an iron alloy, the resultant molten brazing metal begins deeply diffusing into the copper or copper-based alloy of the flange 10 with its peripheral portion being in contact with the molten brazing metal, resulting in an erodingly diffusing layer of a molten alloy including the brazing metal and copper or copper-based alloy. This alloy of the diffusing layer possesses a melting point lower than that of the copper or copper-based alloy of the movable electrical lead rod 7. The diffusing layer of molten alloy will gradually become a relatively large bulk 12. The bulk 12 of molten alloy shrinks as it solidifies in cooling process, thus generating numerous microcracks therewithin by large contracting. These microcracks will result in many macroscopic cracks 13, which in turn may serve as leak paths in a vacuum-tight sealed portion.

SUMMARY OF THE INVENTION

A primary object of the present invention is to provide a vacuum interrupter, a vacuum envelope of which is constructed in a highly reliable vacuum-tight manner.

Another object of the present invention is to provide a vacuum interrupter exhibitting improved vacuum-tightness between at least one electrical lead rod and another member of the vacuum envelope.

To accomplish these objects, the vacuum interrupter of the present invention includes the vacuum envelope including at least one cylinder, two annular end plates connected in a vacuum-tight manner to the opposite ends of the cylinder, a pair of electrical lead rods made of copper or a copper-based alloy, an inner end of each electrical lead rod having an electrical contact and one electrical lead rod being brazed in a vacuum-tight manner to another member of the envelope via a first sealing means, and a bellows of an iron-based alloy surrounding the other electrical lead rod, an outer end of the bellows is joined in a vacuum-tight manner to one end plate and an inner end of the bellows is brazed in a vacuum-tight manner to the other electrical lead rod via a second sealing means, the pair of electrical lead rods being electrically disconnected when the contacts are separated, the first and second sealing means being made of an iron-based alloy in the form of a generally tubular sealing member fitted onto each electrical lead rod and having a groove retaining solid brazing metal and two brazing surfaces opposing the electrical lead rod with a small clearance formed in the inner wall of the sealing member.

According to the present invention, a thin layer of a solid solution of the copper or copper-based alloy of the lead rods and the brazing metal is formed during the heating process of the vacuum-tight brazing of the electrical lead rod to a first or second sealing member. This layer prevents cracks which will be generated during a cooling process after brazing due to an contraction of a diffused bulk being formed by erodingly diffusing the brazing metal into the copper or copper-based alloy in a hermetically brazing, because the molten brazing metal permeates through the small clearance due to wetability and capillary action without erodingly diffusing into the opposing surfaces of the electrical lead rod and the first or second sealing member and results in a vacuum-tight brazing layer which covers a much wider area than the area of the prior art of FIG. 2.

Additionally, even when the electrical contacts of the vacuum interrupter are made of materials containing metals exhibitting a low melting point and a high vapor pressure such as Bi, Te, Sb and/or Pb which can decrease the current chopping value of the vacuum interrupter, but which might dissolve into the molten brazing metal, resulting in faulty vacuum-tightness, these contacts can be installed within the hermetically brazed vacuum envelope of the interrupter because the brazing metal retaining grooves are almost closed from the interior of the vacuum envelope.

U.S. Pat. No. 3,430,015 discloses the means for eliminating the bad effect of Bi, Te, Sb and/or Pb.

Additionally, almost none of the vapors of the brazing metal generated during brazing can disperse out of the brazing metal retaining groove and deposit on the inner surfaces of the insulating members of the vacuum envelope, because the brazing metal retaining groove is almost sealed from the interior of the vacuum envelope. Thus, the dielectric strength of the vacuum envelope will not be adversely affected.

DESCRIPTION OF THE PREFERRED EMBODIMENTS

Figure 1:
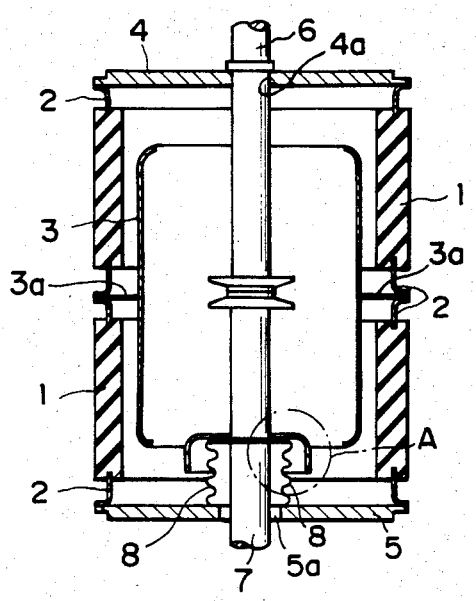
FIG. 1 (Prior Art)
FIG. 1 is a sectional view through a vacuum interrupter of the prior art.
Figure 2:
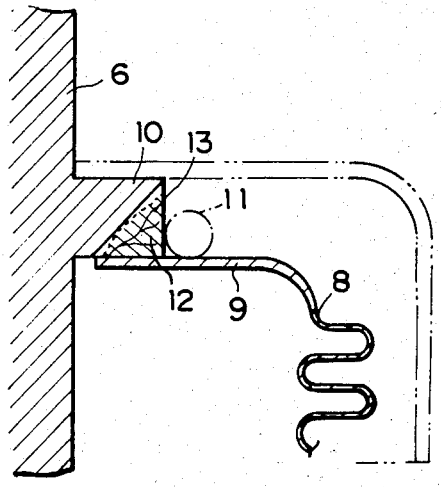
FIG. 2 (Prior Art)
FIG. 2 is an enlarged view of the encircled area A of FIG. 1.
Figure 3:
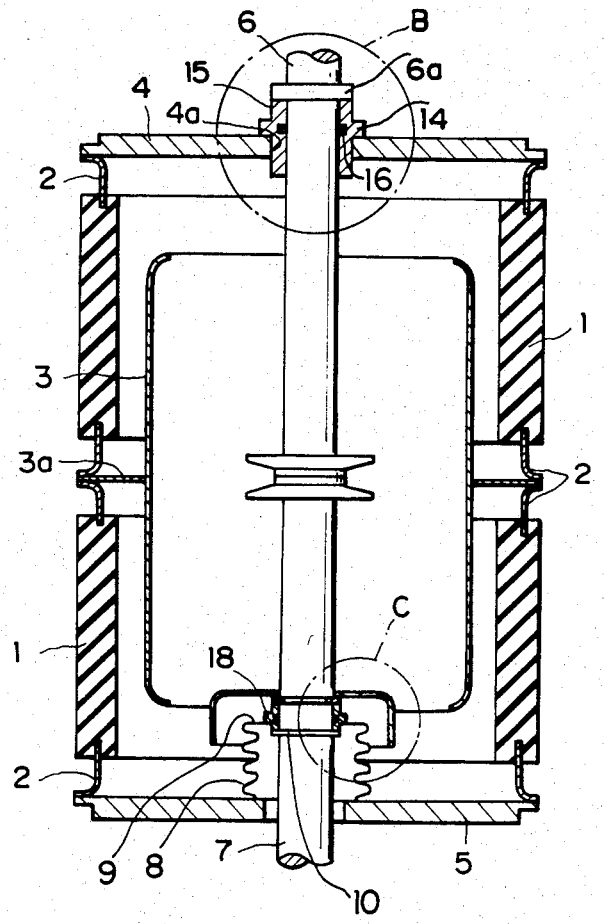
FIG. 3 is a sectional view through the vacuum interrupter of the first embodiment of the present invention.

Referring to FIGS. 3 to 11, the preferred embodiments of the present invention will be described hereinafter in detail. In this description, the reference numerals used in FIGS. 1 and 2 will be used for similar elements in FIGS. 3 to 11 and the description of such elements will not be repeated. FIG. 3 shows the vacuum interrupter in which vacuum-tight brazing has already been completed. However, the other figures show the positioning of the solid brazing metal 11 before heating. For better understanding of the present invention, the following description will be made with regard to a vacuum interrupter in which the solid brazing metals 11 have been positioned but not brazed.

As shown in FIG. 3, in the first embodiment of the present invention, a first tubular sealing member 15 is fitted into a central aperture 4*a* of one metallic end plate 4. The first sealing member 15 is made of stainless steel, an Fe-Ni-Co alloy or an Fe-Ni alloy which will be erodingly diffused and alloy with neither copper- nor silver-based brazing alloys. The first sealing member 15 may be made of magnetic steel if the vacuum interrupter has a relatively low normal current rating.

The first sealing member 15 includes an integral outward flange 14 which abuts the outer surface of the metallic end plate 4. An outer end of the first sealing member 15 abuts a flange 6*a* integral to the body of the stationary electrical lead rod 6.

Figure 4:
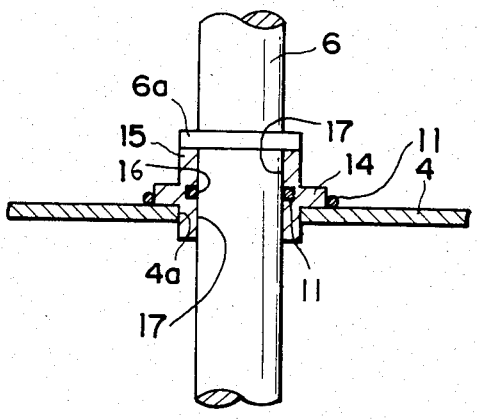
FIG. 4 is an enlarged view of the encircled area B of FIG. 3.

An annular brazing metal retaining groove 16 is provided near the center of the inner wall of the first sealing member 15. As shown in FIG. 4, a ring of solid brazing metal 11 is placed in contact with the periphery of the outward flange 14 and the outer surface of the metallic end plate 4, and another ring of solid brazing metal 11 is placed within the brazing metal retaining groove 16. Groove 16 defines two relatively wide vacuum-tight brazing surfaces 17 on the inside surface of the first sealing member 15 opposing the stationary electrical lead rod 6 with a small clearance.

A second tubular sealing member 18 is fitted onto the surface of the movable electrical lead rod 7 between the annular plate 9 of the bellows 8 and the movable electrical lead rod 7. The second sealing member 18 is made of the same material as the first sealing member 15 and has an integral outward flange 19. The annular plate 9 of the bellows 8 abuts the lower surface of the outward flange 19.

Figure 5:
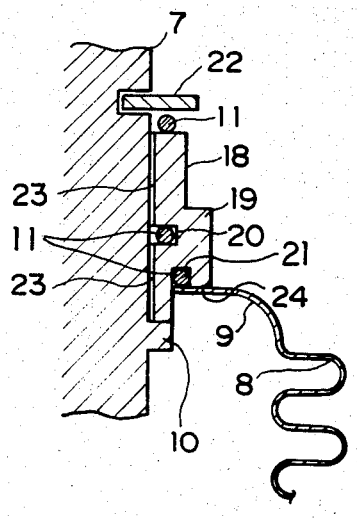
FIG. 5 is an enlarged view of the encircled area C of FIG. 3.

As shown in FIG. 5, an annular brazing metal retaining groove 20 is formed in the part of the inner wall of the second sealing member 18 opposite the outward flange 19. An annular brazing metal retaining groove 21 is also formed in the lower surface of the outward flange 19 opposite the edge of the annular plate 9.

A lower end of the second sealing member 18 abuts the upper surface of the flange 10 of the movable electrical lead rod 7. An upper end of the second sealing member 18 faces with a small clearance a C-shaped snap ring 22 which is fitted into a positioning groove in the movable electrical lead rod 7. The C-shaped snap ring 22 serves to prevent axial movement of the second sealing member 18 before the vacuum-tight brazing process. The rings of solid brazing metal 11 are placed on the upper end of the second sealing member 18 and within the brazing metal retaining grooves 20 and 21. Two relatively wide vacuum-tight brazing surfaces 23 which face the surface of the movable electrical lead rod 7 across a small clearance are defined above and below the brazing metal retaining groove 20. Additionally, the lower end of the second sealing member 18 serves as a vacuum-tight brazing surface. An annular vacuum-tight brazing surface 24 is defined on the lower surface of the flange 19 to the outside of the brazing metal retaining groove 21.

In cases where the second sealing member 18 is machined from a pipe or a round bar of stainless steel or normal steel which material has been rolled in its axial direction, the member 18 will unusually include axially and locally extending microcracks due to nonmetallic impurities and/or bubbles in the material. However, since the machined surfaces of the upper end of the second sealing member 18, the walls of the brazing metal retaining grooves 20 and 21, the lower end of the second sealing member 18, and the lower surface of the outward flange 19, as shown in FIG. 5, are entirely covered with brazing metal layers after the vacuum-tight brazing, there will be no leak paths in regard to the hermetic seal through the second sealing member 18 itself. In particular, there will be no leak paths in regard to the hermetic seal between the brazing metal retaining grooves 20 and 21 even though the grooves 20 and 21 partially overlap.

Additionally, the outer diameter of the lower end of the second sealing member 18 is equal to the diameter of the flange 10 of the movable electrical lead rod 7, which further enhances vacuum-tightness by limitting the chance for leaks leading through the body of the second sealing member 18 to the brazing metal retaining groove 20.

Figure 6:
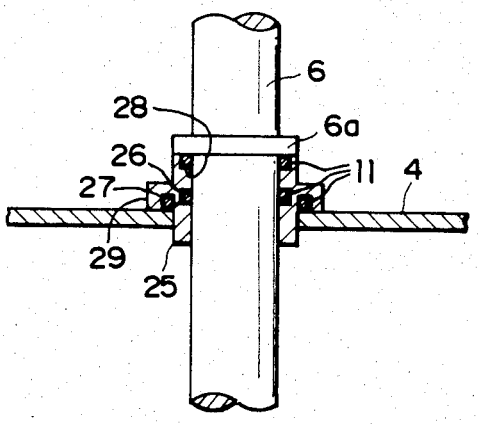
FIG. 6 shows a modification of the vacuum-tight structure of FIG. 4.

FIG. 6 shows a first modified sealing member 25 which connects the stationary electrical lead rod 6 to the metallic end plate 4 in a vacuum-tight manner. The first sealing member 25 is made of the same material as the first sealing member 15 of FIG. 4 and includes an integral outward flange 29. Brazing metal retaining grooves 26, 27 and 28 are provided near the center of the inner wall of the first sealing member 25, on the lower surface of the outward flange 29 and at the upper edge of the inner wall of the first sealing member 25, respectively.

The inner wall, the upper edge, and the lower surface of the outward flange 29 all of the first sealing member 25 serve as vacuum-tight brazing surfaces.

Figure 7:
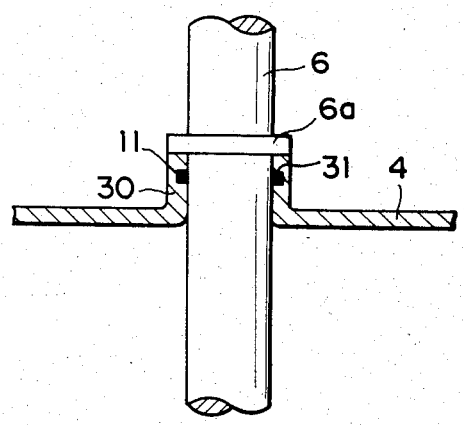
FIG. 7 shows another modification of the vacuum-tight structure of FIG. 4.

FIG. 7 shows a first tubular sealing member 30 integral to the metallic end plate 4. The first sealing member 30 obviates the need to prevent the generation of leak paths through the metallic end plate 4, because the metallic end plate 4 is long enough along the rolling direction of its material which is perpendicular to the thickness of the end plate 4. A brazing metal retaining groove 31 is provided near the center of the inner wall of the first sealing member 30 which serves as a vacuum-tight brazing surface.

Figure 8:
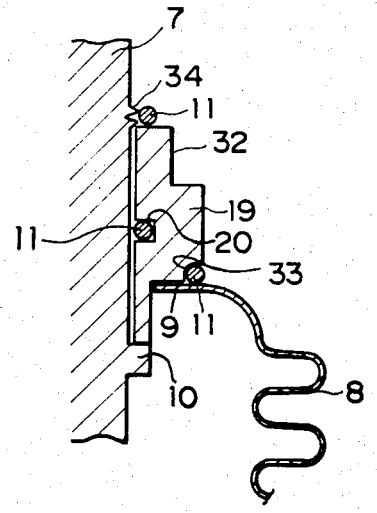
FIG. 8 shows a modification to the vacuum-tight structure of FIG. 5.

FIG. 8 shows a modification to the vacuum-tight brazing structure of the movable electrical lead rod 7 and the bellows 8. In this modification, a second sealing member 32 includes a brazing metal retaining groove 33 instead of the brazing metal retaining groove 21 of FIG. 5. The brazing metal retaining groove 33 is in the form of a concave chamfer in the outer edge of the lower surface of the outward flange 19. In this case, the remainder of the lower surface of the outward flange 19 defines a vacuum-tight brazing surface to the inside of the brazing metal retaining groove 33 and the brazing metal retaining grooves 20 and 33 do not overlap. Thus, there can be no leak paths between the lower surface of the outward flange 19 and the brazing metal retaining groove 20. Additionally, three circumferentially equidistantly punched edges 34 are formed in the surface of the movable electrical lead rod 7. The second sealing member 32 is secured to the movable electrical lead rod 7 and the flange 19 by means of the punched edges 34 before the vacuum-tight brazing.

Figure 9:
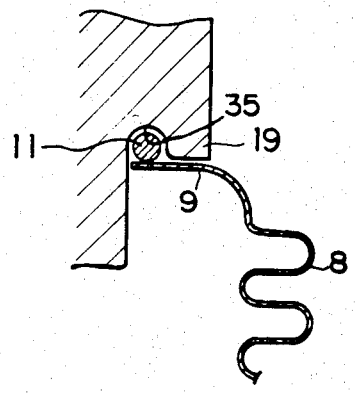
FIG. 9 shows a modification to the brazing metal retaining groove.

FIG. 9 shows a brazing metal retaining groove 35 with a U-shaped wall. The groove 35 which can replace the above brazing metal retaining grooves having square cross-sections includes an annular chamfer in its outer edge by which the molten brazing metal can easily flow out of the brazing metal retaining groove 35 and smoothly permeate through the small clearance between the lower surface of the flange 19 and the annular plate 9 of the bellows 8.

Although all of the brazing metal retaining grooves described above were formed by milling, they may alternatively be formed by pressing.

The vacuum interrupter is conventionally hermetically brazed after the rings of solid brazing metal 11 have been placed within the corresponding brazing metal retaining grooves and other brazing metal sealing locations. During brazing, the molten brazing metal permeates through the small clearances between each of the vacuum-tight brazing surfaces of the first sealing member 15, 25 or 30 and second sealing member 18 or 32 and the surfaces of the opposing member of the vacuum envelope due to the wetability and capillary action between the molten brazing metal and the surfaces. In more detail, since the surfaces of the stationary and movable electrical lead rods 6 and 7 face the vacuum-tight brazing surfaces of the first sealing member 15, 25 or 30 and second sealing member 18 or 32 over wide areas with small clearances, the solid brazing metals 11 which have been completely melted within the solid brazing metal retaining grooves supply with just the amount of molten brazing sufficient for brazing without erodingly diffusing into the stationary and movable electrical lead rods 6 and 7 by means of the small clearances. In conclusion, crack-free vacuum-tightnesses can be obtained between the stationary and movable electrical lead rods 6 and 7 and each of the first sealing member 15, 25 and 30 and second sealing member 18 and 32.

Figure 10:
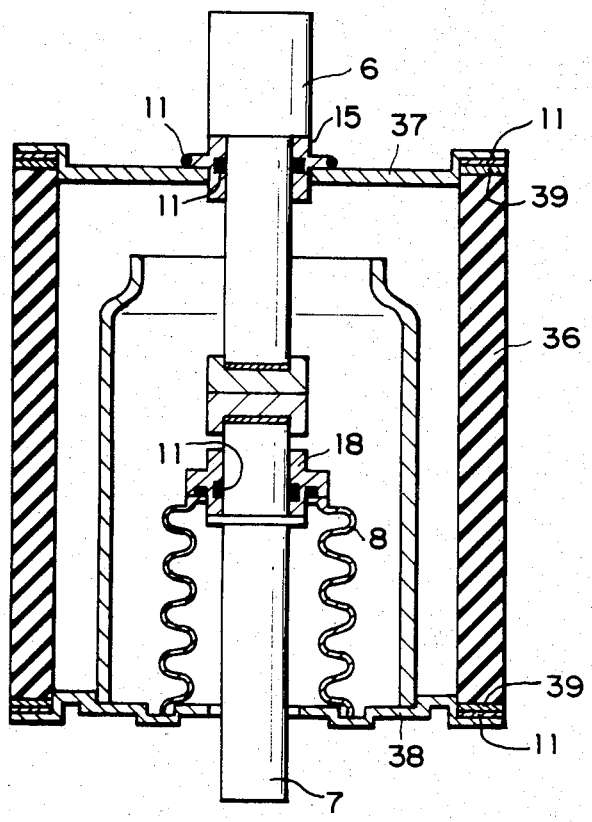
FIG. 10 is a sectional view through the vacuum interrupter of the second embodiment of the present invention.

FIG. 10 shows a vacuum interrupter of the second embodiment of the present invention. The vacuum envelope of the interrupter comprises an insulating cylinder 36 of glass, alumina ceramics or the like, two annular metallic end plates 37 and 38 brazed vacuum-tight to the opposite ends of the insulating cylinder 36, a stationary electrical lead rod 6, a first sealing member 15, a movable electrical lead rod 7, a bellows 8 and a second sealing member 18. The metallic end plates 37 and 38 are made of Fe-Ni alloy or Fe-Ni-Co alloy. The coefficients of thermal expansion of the metallic end plates 37 and 38 and the insulating cylinder 36 are substantially equal. An annular metallized layer 39 is deposited on each of the opposite ends of the insulating cylinder 36. A ring of solid brazing metal 11 is placed between each metallized layer 39 and each of the metallic end plates 37 and 38. Additionally, rings of solid brazing metal 11 are placed within each of the brazing metal retaining grooves of the first and second sealing members 15 and 18 and at each of the other brazing metal seal locations. The vacuum interrupter is conventionally hermetically brazed in a highly evacuated furnace after being assembled as shown in FIG. 10. Thus, a vacuum envelope including crack-free, vacuum-tight seals can be obtained as in the case shown in FIG. 3.

Figure 11:
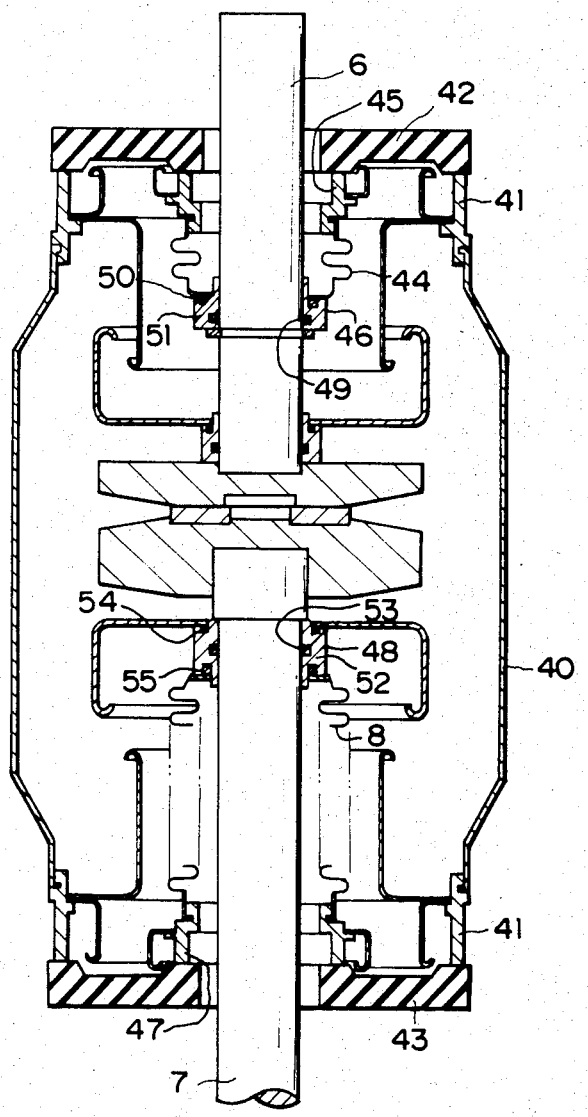
FIG. 11 is a sectional view through the vacuum interrupter of the third embodiment of the present invention.

FIG. 11 shows a vacuum interrupter of the third embodiment of the present invention. The vacuum envelope of the interrupter comprises a metallic cylinder 40, two annular insulating end plates 42 and 43 of insulating ceramics brazed vacuum-tight to the opposite ends of the metallic cylinder 40 via two tubular sealing members 41, a stationary electrical lead rod 6, a mechanical shock absorbing bellows 44 of stainless steel or normal steel which encircles the stationary electrical lead rod 6, a sealing member 45 connecting the outer end of the bellows 44 to the insulating end plate 42 in a vacuum-tight manner, a first tubular sealing member 46 used to braze the inner end of the bellows 44 in a vacuum-tight manner to the stationary electrical lead rod 6, a movable electrical lead rod 7, a contact opening and closing bellows 8 encircling the movable electrical lead rod 7, a sealing member 47 connecting the outer end of the bellows 8 to the insulating end plate 43 in a vacuum-tight manner, and a second tubular sealing member 48 used to braze the inner end of the bellows 8 in a vacuum-tight manner to the movable lead rod 7.

The first sealing member 46 is made of the same material as the first sealing member 15. A brazing metal retaining groove 49 is provided in the inner wall of the first sealing member 46. A brazing metal retaining groove 50 is provided along the inner edge of the upper surface of the outward flange 51 of the first sealing member 46. Vacuum-tight brazing surfaces are defined in the inner wall of the first sealing member 46 above and below the brazing metal retaining groove 49. A vacuum-tight brazing surface is also defined in the upper surface of the outward flange 51 to the outside of the brazing metal retaining groove 50.

The second sealing member 48 is made of the same material as the first sealing member 15. A brazing metal retaining groove 53 is provided near the center of the inner wall of the second sealing member 48. Brazing metal retaining grooves 54 and 55 are provided on the upper and lower surfaces respectively of the outward flange 52 of the second sealing member 48. Vacuum-tight brazing surfaces are defined in the inner wall of the second sealing member 48 above and below the brazing metal retaining groove 53, and in the upper and lower surfaces of the outward flange 52 to the outside of the brazing metal retaining grooves 54 and 55. The sealing members 41, 45 and 47 are made of an Fe-Ni alloy or an Fe-Ni-Co alloy.

What is claimed is:

1. A vacuum interrupter including an envelope which comprises at least one cylinder, two annular end plates connected in a vacuum-tight manner to the opposite ends of the cylinder, a pair of electrical lead rods of copper or a copper-based alloy, an inner end of each electrical lead rod having an electrical contact, and one electrical lead rod being brazed in a vacuum-tight manner to one end plate via a first sealing means, and a bellows of an iron-based alloy surrounding another electrical lead rod, an outer end of the bellows being joined in a vacuum-tight manner to another end plate and an inner end of the bellows being brazed in a vacuum-tight manner to the other electrical lead rod via a second sealing means, the pair of electrical lead rods being electrically disconnected when the contacts are separated, wherein the first and second sealing means have generally tubular sealing members made of an iron-based alloy and fitted onto the corresponding electrical lead rod, and wherein a groove retaining a solid brazing metal and two vacuum-tight brazing surfaces opposing the corresponding electrical lead rod with a small clearance are formed in the inner wall of each sealing member.

2. A vacuum interrupter as defined in claim 1, wherein the brazing surfaces are defined in said inner walls of the first and second sealing members on both sides of the brazing metal retaining grooves.

3. A vacuum interrupter as defined in claim 1, wherein at least one of the first and second sealing members is made of stainless steel.

4. A vacuum interrupter as defined in claim 1, wherein at least one of the first and second sealing members is made of Fe-Ni alloy.

5. A vacuum interrupter as defined in claim 1, wherein at least one of the first and second sealing members is made of Fe-Ni-Co alloy.

6. A vacuum interrupter as defined in claim 1, wherein the brazing metal retaining groove has a U-shaped cross-section.

7. A vacuum interrupter as defined in claim 1, wherein both the end plates are made of an iron-based alloy and the cylinder is made of an insulating material.

8. A vacuum interrupter as defined in claim 1, which further comprises said first sealing means including a bellows made of an iron-based alloy.

9. A vacuum interrupter as defined in claim 1, wherein the solid brazing metal is an alloy containing copper or silver.

10. A vacuum interrupter as defined in claim 1, at least one of the sealing members is integral part of the annular end plate.

* * * * *